United States Patent [19]

Day et al.

[11] Patent Number: 4,572,075

[45] Date of Patent: Feb. 25, 1986

[54] METHODS AND APPARATUS FOR LOADING A BOREHOLE WITH EXPLOSIVES

[75] Inventors: John T. Day, Sandy; Lex L. Udy, Holladay, both of Utah

[73] Assignee: Mining Services International Corporation, Salt Lake City, Utah

[21] Appl. No.: 592,306

[22] Filed: Mar. 21, 1984

[51] Int. Cl.[4] ..... F42B 3/00

[52] U.S. Cl. ..... 102/313; 102/312; 102/323; 102/324; 102/331; 102/333

[58] Field of Search ..... 102/312, 313, 323, 324, 102/333, 331; 86/20 C

[56] References Cited

U.S. PATENT DOCUMENTS

| | | | |
|---|---|---|---|
| 2,745,346 | 5/1956 | Aitchison et al. | 86/20 C X |
| 3,087,425 | 4/1963 | Griffith, Jr. | 102/323 |
| 3,303,738 | 2/1967 | Clay et al. | 86/20 |
| 3,361,023 | 1/1968 | Collins et al. | 86/20 C |
| 3,380,333 | 4/1968 | Clay et al. | 86/20 |
| 3,949,673 | 4/1976 | Lyerly | 102/324 X |
| 3,986,430 | 10/1976 | Coursen et al. | 102/313 X |

OTHER PUBLICATIONS

"Improve a Great Idea?", Ireco Chemicals.

"Squeez-Crete Concrete Pumps", Challenge-Cook Brothers, Inc., (1977).

"Challenge Squeez-Crete," Challenge-Cook Brothers, Inc. (1982).

*Primary Examiner*—Peter A. Nelson

*Attorney, Agent, or Firm*—Workman, Nydegger & Jensen

[57] ABSTRACT

A method and apparatus for delivering an explosive to the bottom of a borehole containing water without allowing a detrimental amount of mixing between the explosive and the water. More particularly, the present invention allows an ammonium nitrate rich bulk explosive to be placed in a borehole without allowing the explosive composition to change significantly through dissolution of its constituents. The apparatus of the present invention includes a length of collapsible tubing having a plurality of apertures near its base and a weight attached to its base. The tubing is then lowered into a borehole. The weight causes the tubing to extend through any water layer within the borehole and the collapsible nature of the tubing serves to keep any significant amount of water from entering the tube. An explosive can then be flowed into the mouth of the tubing and down through the length of the tubing to the bottom of the borehole. At the bottom of the borehole, the explosive exits the tubing through the plurality of apertures.

18 Claims, 3 Drawing Figures

METHODS AND APPARATUS FOR LOADING A BOREHOLE WITH EXPLOSIVES

BACKGROUND

1. The Field of the Invention

The present invention relates to methods and apparatus for use in delivering an explosive to the bottom of a borehole partially filled with water without exposing the explosive to an unacceptable amount of water.

2. The Prior Art

Since the advent of the porous ammonium nitrate prill, the dry blasting agent which combines prilled ammonium nitrate ("AN") with fuel oil ("FO"), commonly referred to in the trade as "ANFO," has become the most widely used blasting agent in the world. A simple mixture of AN and FO in the ratio of 94:6 (AN:FO) results in an explosive having a nearly perfect oxygen balance.

The low cost and ease of manufacture of ANFO are its significant advantages. Moreover, the ease of applying ANFO is advantageous since ANFO can be simply poured into a borehole for detonation below ground.

However, ANFO is disadvantageous in that it has a low bulk strength (i.e., blasting energy per unit of volume). As a result, in order to obtain the necessary blasting energy from ANFO, it has been necessary to increase the diameter of the borehole, thereby increasing the drilling costs.

Moreover, ANFO is disadvantageous in that it has a low water resistance. Thus, when the ammonium nitrate prills are exposed to water, they begin to dissolve. As the ammonium nitrate content of the explosive mixture is reduced, the efficiency of the explosive charge is correspondingly reduced. Importantly, if the ammonium nitrate content of the mixture is substantially reduced, it may be impossible to reliably initiate the explosive.

In general, boreholes used for placing explosives below ground vary from 6 to 17 inches in diameter. In hard rock, the depth of the borehole is defined by the bench height and is typically from 20 to 60 feet in depth, and in coal stripping operations, the depth of the boreholes varies from 5 to 200 feet. In such boreholes, it is not unusual for water from the surrounding formation to flow into the hole. While the water flow may vary in intensity, any substantial amount of water in a borehole can potentially adversely affect the ammonium nitrate explosive used.

It is necessary, therefore, that the ANFO explosive be placed in the bottom of the borehole without a substantial amount of interface with water so as to minimize the resulting dissolution of ammonium nitrate. Even when there is a simple interface between the water and the mass of explosive, the percentage composition of the explosive can be adversely affected. Thus, simply pouring the ANFO explosive mixture into the borehole has proven to be an unacceptable procedure when the borehole is partially filled with water.

Because of these problems, various attempts have been made to develop an adequate method for placing an ANFO explosive charge in a borehole without overly exposing the explosive to water which may have accumulated in the borehole.

One method which has been developed for loading ANFO into a borehole partially filled with water involved pumping the water out of the borehole with a submergible pump. Once the hole is sufficiently "dewatered," a liner is placed in the hole to prevent the hole from again filling with water. This liner may be constructed in a number of ways, but generally, it employs an impermeable polyethylene layer. The explosive ANFO mixture is then quickly introduced into the liner before water reenters the borehole.

This "dewatering" method allows the charge to be placed in the borehole with essentially no mixing with water. However, the method has the disadvantages that (1) the water may not be able to be pumped from the borehole because the water enters faster than it can be pumped out, (2) the liners can be ripped or punctured, thereby allowing water to enter the ANFO column, and (3) an expensive dewatering apparatus is necessary at the mining site. This dewatering method is also cumbersome and expensive because of the necessity to remove all of the water from the borehole, the cost of the liner used, and the labor intensive process of inserting the liner into the borehole.

Another method for loading boreholes has been to modify the ANFO explosives so that they have a density greater than water and then to package the explosive in waterproof bags made of materials such as polyethylene or polypropylene. In order to increase the density of ANFO (which is typically 0.82–0.9 gm./c.c.), commercial formulators have crushed the ANFO prills to eliminate the void volumes between the prills or have added other components (such as inert compounds to increast the density of the explosive.

Such bagged products are generally manufactured away from the mine at a fixed plant and then transported and stored as an explosive at the mine until used. The bagged product is then placed in the water-filled borehole to the proper loading height. Where a few bags can be used to effectively "dry-up" the borehole with small quantities of water, bulk ANFO is often loaded on top to complete the loading.

While the use of bagged products has proven satisfactory at some mining sites, it has several disadvantages: (1) there is an increased cost per unit weight; (2) there is the need for special handling and storage; (3) the borehole loading operation is labor intensive; and (4) the blasting strength of the explosive is reduced because the entire volume of the borehole is not completely filled with explosives (this phenomenon is commonly referred to as "decoupling").

As a result of the difficulties in using ANFO and other dry explosives in wet boreholes, water-resistant bulk blasting agents have been developed for use in boreholes which are partially filled with water. The earliest type, slurry explosives, include a water solution of saturated nitrates (primarily ammonium nitrate) containing a sensitizer, such as paint-fine aluminum, a molecular explosive or finely dispersed droplets of fuel oil. This matrix if thickened with guar gums and/or starches to prevent stratification of the components, and as the liquid slurry is placed in the borehole, a cross-linking agent is generally added to gel the matrix into a semi-solid in the bottom of the borehole.

Most of the slurry explosives which have been developed contain water in the range of from 15% to 20%; however, the use of such substantial amounts of water lowers the weight strength (the blasting energy per unit of weight) of the base slurry to around 75% of the weight strength of ANFO. To overcome the lower weight strength, a larger quantity (i.e., more weight) of the expensive slurry must be used to obtain the same blasting strength as ANFO.

To increase the lower weight strength of traditional slurry explosives, some commercial formulators have added up to 25% ammonium nitrate prills to the slurry in order to reduce the effective water content. Others have developed formulations where granular aluminum, a very expensive ingredient (which can cost five to eight times more per pound than the base slurry), is added in quantities up to 25% to increase the weight strength of the explosive.

Moreover, in order to properly initiate detonation of all of these slurry explosives, void volumes must be added to the slurry by trapping air in the slurry, by the use of chemical gassing techniques, or by the addition of hollow microspheres to the slurry. Thus, it will be appreciated that the cost of manufacturing effective water-resistant slurry explosives is very high.

In general, bulk slurries have been loaded through conduits which are made rigid in order to prevent hose collapse. The slurry products are not generally capable of being dropped down through the water-filled holes because: (1) there would be dissolution of solid particles, such as AN prills; (2) the slurry would be diluted with water because cross linking is not completed; (3) occluded water globules would be trapped in the matrix at the bottom of hole; and (4) there is the possibility that the slurry would float due to chemical gassing (this is because the ambient density of gassed slurry may be less than 1.0 gm./c.c.; but at bottom of the hole, due to static pressure of slurry and water head pressure, it is greater than 1.0 gm./c.c.).

As a result, a pump is used to force the slurry through the one- to three-inch conduit to the bottom of the borehole; generally pressures in the range from 20 psi to 60 psi are necessary for the very thin slurries, and pressures as high as 600 psi are necessary for the thick slurries with larger quantites of solids. The slurry fills up the bottom of the hole without extensively mixing with the water in the hole. Essentially, there is only a single interface between the water and the slurry explosive, and this interface is not sufficient to cause extensive dissolution of ammonium nitrate.

Unfortunately, several problems are encountered in the use of such a small diameter hose in pumping slurry explosives. Foremost among the problems is the necessity of obtaining, transporting, and operating an expensive pumping apparatus. Since pressures as high as 600 psi are necessary to pump the explosive, a relatively powerful pump is required. The pressures, however, can result in ruptures of the hose, and such ruptures of hoses carrying explosives under high pressure can pose a serious safety hazard.

It has been found that for some types of slurry explosives to be suitable for pumping, they must have a relatively high initial water content. Such mixtures are referred to in the trade as "thin" and may not constitute an effective explosive mix. It has also been found that the high pumping pressure required compresses the explosive mixture. The result of such compression is that the void volume in the explosive mixture is reduced to an undesirable level, the microspheres in the explosive may rupture, and/or the air bubbles may coalesce.

Moreover, such pumping procedures often take an unacceptable amount of time to fully load a borehole with explosive. The result is that such pumping procedures are expensive and cumbersome, in that: (1) they employ an extensive amount of equipment; (2) they may result in a less than desirable explosive charge being put in place; and (3) they involve very serious safety risks.

In addition, it is generally necessary to retract the conduit as the slurry is pumped into the region just below the water-slurry interface. One reason for this procedure is that the slurry is in the process of being cross-linked. Thus, if up to two tons of material are being pumped into the borehole at the rate of 400 pounds per minute, the hose may be frozen into the matrix if it is not removed until the pumping is complete.

Moreover, after the hole is loaded, the hose is generally blown free of slurry by a burst of air. If the air mixes with the slurry and water, detrimental effects may ensue. Thus, this requires that care be taken in gradually withdrawing the conduit from the borehole. If variable energy loads are pumped into the hole, the reverse order of materials would have to be pumped if the conduit were not retracted during pumping. Otherwise, a greater chance of intermixing of strengths of the different explosives would result.

Finally, in deep boreholes, the rate of chemical gassing may have to be varied so that there is more at the bottom and less at the top in order to prevent floating. If the hose is not retracted during loading, the lower gassed product at the top of the column must be pumped first, followed by the higher gassed product at the bottom. This may lead to significant intermixing, because the viscosity of the first material pumped will be much higher than the subsequently pumped material due to cross-linking of the slurry.

Unfortunately, the problems associated with the pumping of these slurry explosives and the need to provide a formulation with a satisfactory weight strength formation has required a compromise in balancing of the need for fluidity in order to ease pumping difficulties of the slurry with the desire to add prilled AN which increases the viscosity of the slurry. The more water the slurry contains, the easier it is to handle; however, the weight strength is reduced unless expensive aluminum is added. Therefore, AN prill content in excess of 25% by weight of the slurry is seldom utilized, thereby resulting in a product having a much higher cost per unit of energy.

Recently, a new type of water resistant blasting agent, generally called "emulsions," has been introduced into the mining community. The emulsions include an aqueous saturated nitrate solution which is emulsified into small droplets in a continuous phase or menstrum of fuel oil, waxes, or mineral oils. The base emulsion used in bulk blasting, like the slurry explosives, has added water and yields a weight strength of about 75% of ANFO.

Since the continuous phase is based on hydrocarbon materials, rather than on the aqueous solution used in slurry explosives, it has a greasy characteristic with some inherent water resistance. Thus, in order to increase its weight strength, AN prill can be added along with aluminum granules. The thickness or viscosity of the various base emulsions varies greatly from a few hundred poises to several tens of thousands of poises. As with slurry explosives, it is often necessary to introduce void volumes into the emulsion by the addition of hollow microspheres made of glass, perlite or hollow fly ash. Unfortunately, the result is even a thicker emulsion.

As will be readily appreciated from the foregoing, like slurry explosives, it is necessary to pump emulsions in order to get the explosive to the bottom of the borehole. And like slurry explosives, the process of pumping emulsions results in numerous problems and compromises. While there is no cross-linking of the emulsion product, there is always the problem of dealing with occluded gas.

Moreover, while the addition of greater quantities of AN prill or aluminum apparatus yields a more energy efficient blasting agent in terms of weight strength and bulk strength, it also results in a much more viscous product which is difficult to pump using the prior art techniques.

It is apparent that what are needed in the art are methods and apparatus for easily and inexpensively placing a bulk explosive mixture in the bottom of a borehole while still avoiding an undesirable amount of mixing with water that may have collected in the bore hole. It would be an advancement in the art if this could be achieved without pumping the explosive into the hole at high pressures, without dewatering the borehole, and without lining the borehole.

It would be another advance in the art to provide a process for loading the viscous bulk explosive mixtures into a borehole partially filled with water without substantially reducing the blasting energy of the explosive. It would be a still further advancement in the art to be able to place an effective explosive charge at the bottom of a borehole containing some water without having to utilize the expensive thin slurry and emulsion explosives of the prior art. Such methods and apparatus are disclosed and claimed in this application.

BRIEF SUMMARY AND OBJECTS OF THE INVENTION

The present invention is directed to novel methods and apparatus for placing a quantity of explosive in a borehole without allowing the explosive to mix unduly with any water which may have collected in the hole. The apparatus of the present invention includes a collapsible tube which is long enough to reach the level where the explosive is desired. One end of the tube is weighted so that it can be readily dropped into the hole and so that the tube will extend to the bottom of the hole. The weight is useful in assuring that the tube will extend through any water which may have collected in the hole.

When the tube is placed in the borehole, any water in the hole collapses the tube up to the water level. Therefore, no significant amount of water will enter the tube even if the tube is constructed of water permeable material. The explosive mixture, which is preferably water resistant, is then fed into the top of the tube. The explosive may temporarily collect at the water level, however, as additional explosive is added there will be enough explosive to counter the water pressure on the tube and the explosive will continue to travel to the base of the tube. The base of the tube will contain apertures so that the explosive can flow out of the tube and fill the bottom of the borehole. By employing this method, there is very little mixing between the explosive and the water in the hole. Essentially, the only interaction between the water and the explosive is the interface between the explosive at the bottom of the hole and the water layer above the explosive. This interface is not sufficient to cause a significant amount of AN dissolution or to change the composition of the explosive.

It is, therefore, a primary object of the present invention to provide methods and apparatus for delivering a bulk explosive to the bottom of a borehole without exposing the explosive to a detrimental amount of water that may have collected in the borehole.

More particularly, it is an object of the present invention to provide methods and apparatus for introducing a thick ammonium nitrate rich explosive into a borehole without causing the AN prills in the explosive to dissolve and without reducing the blasting energy of the explosive mixture.

A further object of the present invention is to allow explosives to be rapidly placed in a borehole without the necessity of employing an expensive and complex pumping apparatus, with its related hoses, and without adversely eliminating the void volume within the explosive mixture.

Another object of the present invention is to allow an explosive to be placed in a borehole without the necessity of dewatering or lining the borehole.

It is still another object of the present invention to be able to place an effective explosive charge at the bottom of a borehole containing water without having to utilize the expensive thin slurry and emulsion explosives of the prior art.

Other objects and advantages of the invention will become apparent upon reading the following detailed description and appended claims, and upon reference to the accompanying drawings.

DETAILED DESCRIPTION OF THE PREFERRED EMBODIMENT

Figures 1, 2, 3:
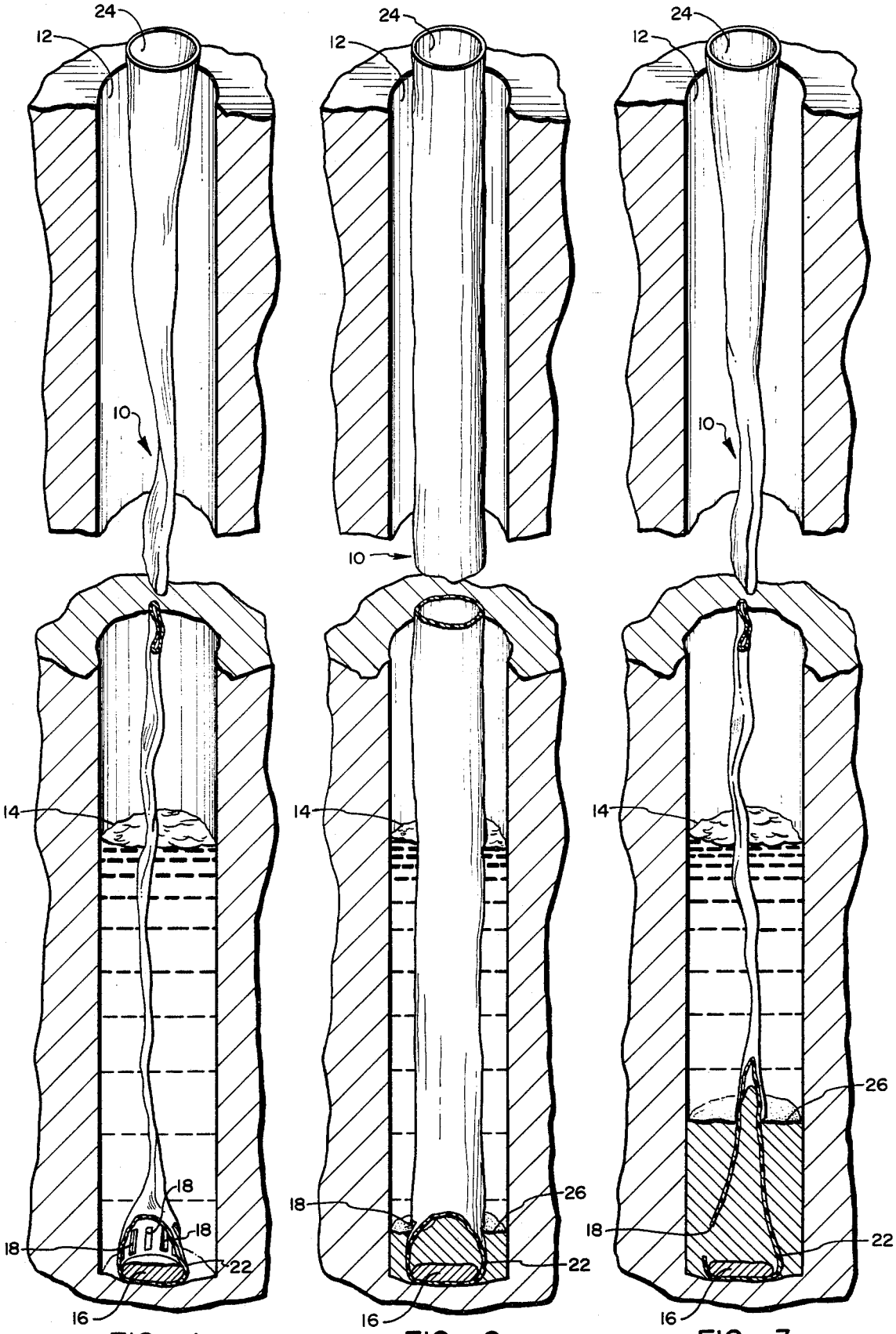
FIG. 1 is a perspective view of the preferred embodiment of the invention placed within a borehole, but before the hole has been loaded with explosives, with the base of the tube cut away.
FIG. 2 is perspective view of the preferred embodiment of the invention placed within a borehole as the hole is being loaded with explosives, with the base of the tube cut away.
FIG. 3 is a perspective view of the preferred embodiment of the invention placed within a borehole after the hole has been loaded with explosives, with the base of the tube cut away.

The present invention is intended in large part to facilitate the delivery of bulk explosives in a fluid or semi-fluid form to the bottom of a borehole and is particularly useful in delivering explosive mixtures into boreholes having significant amounts of water therein.

Reference is next made to the drawings wherein like parts are designated with like numerals throughout. FIG. 1 represents a presently preferred embodiment of the apparatus of the present invention positioned within a borehole partially filled with water. The tubing of the present invention is generally designated 10 and the borehole is generally designated 12. The water level within the borehole is designated 14.

The tubing 10 can be constructed of any relatively durable material that would tend to collapse when extended under water. The tubing, of course, can be of any length and diameter desirable in order to load any particular borehole with explosives. Furthermore, the tubing may be somewhat water permeable and may still be effective for the purposes of the present invention.

In one embodiment of the present invention, the tubing is approximately $9\frac{7}{8}$ inches (25.3 centimeters) in diameter and is long enough to extend to the bottom of a typical borehole, which is about 60 feet (18.3 meters) deep. It has been found that this diameter of tubing is easily used in connection with a 15-inch diameter (38.5 centimeters) borehole and is also wide enough to allow "thick AN millrich" explosives to be easily and quickly moved through the tubing to the bottom of the hole. However, in the event holes of significantly different diameters are to be loaded, it would be possible to use tubing of a different diameter.

One suitable material used for construction of the tube 10 is a woven polypropylene. This material is water permeable, however, as will be discussed more fully below, the empty tubing collapses while in water so that no significant amount of water enters the tube 10. Indeed, the presence of a small amount of water within the tube 10 may actually be beneficial because it can act as a lubricant to allow the explosives to more readily flow through tube 10. In any event, any material with similar properties could be substituted. The important characteristics of the material used to make the tube 10 are that it be durable enough to hold the explosive as it is flowed through the tube 10 and that the tube 10 collapses while it is empty as it is extended under water.

Placed within the bottom of tube 10 or attached to the end of tube 10 is a weight 16. The weight 16 may be anything which causes the bottom end of the tube 10 to sink. The weight allows tube 10 to be extended through the entire length of the borehole from top to bottom. One suitable weight for use in tube 10 is a quantity of rock or drill cuttings found at the surface. It will be appreciated that any other weight would also suffice.

The weight 16 can be attached to the tube 10 in any desirable manner. One method of attaching the weight 16 is to simply seal the bottom end of the tube 10 and then place the weight 16 in the tube. Another successful technique is to form a pouch or pocket at the bottom of the tube 10 into which the weight is placed. Other possibilities include attaching the weight 16 to the bottom of the tube 10 such as by using a length of rope or string. Again, any procedure whereby the bottom end of the tubing is weighted sufficiently to cause it to be extended under water will be satisfactory.

Referring now to FIG. 1, the presently preferred embodiment of tube 10 will have apertures 18 configured in order to allow the explosive mixture 26 to flow out of tube 10. The holes 18 are placed so that the explosive mixture 26 will exit tube 10 at the desired location. It is presently anticipated that for most uses apertures 18 will be at or near the base 22 end of tube 10 so that the explosive mixture 26 will flow into the bottom of the borehole 12.

In order to use the present invention in connection with an existing borehole 12, an appropriate length of tubing 10 will be obtained. Weight 16 will then be placed within or attached to one end of tube 10. In addition, holes 18 will be cut into tube 10. Once this is done, tube 10 will be ready to be positioned within borehole 12. Clearly, the size, shape and number of apertures 18 are not determinating features of the invention except to the extent that apertures 18 permit the explosive mixture 26 to flow out of tube 10 and into borehole 12. Thus, explosive mixtures which are more viscous may desirably be used with tubes 10 having larger and more numerous apertures 18 than may be required of less viscous explosives.

Tube 10 is let down into borehole 12. Assuming that borehole 12 has water beginning at level 14, as illustrated in FIGS. 1 through 3, it will be necessary to make certain that weight 16 is heavy enough to allow tube 10 to continue to be lowered through the water layer.

Referring again to FIG. 1, tube 10 is illustrated as being appropriately positioned within borehole 12. As can be seen in FIG. 1, tube 10 is at least partially open between the borehole surface and the water level 14. Below the water level 14, however, the pressure of the water collapses tube 10. As a result, only a minimal amount of water is allowed within tube 10 even when tube 10 is constructed of a water permeable material such as woven polypropylene. At this point, tube 10 is ready to receive a quantity of explosives.

FIG. 2 illustrates tube 10 being used to position explosives within borehole 12. Explosives 26 are put into place simply by a gravity feed technique where the explosives are introduced into mouth 24 of tube 10 and allowed to flow down through tube 10. Because a gravity feed technique is utilized, essentially the same basic equipment (e.g., auger discharge) may be used for introducing the explosives in the borehole which does not contain a substantial amount of water as is used for introducing explosives 26 in borehole 12 which is partially filled with water. Thus, the need for the complex and expensive pumping equipment of the prior art is eliminated.

In a typical drilling operation, some boreholes will be partially filled with water while other boreholes are not. Thus, using the loading techniques of the prior art, pumping operations would be used to fill the boreholes partially filled with water, while other discharge techniques would be used to fill the dry boreholes. Thus, it will be readily appreciated that the present invention has the additional advantage over the prior art of allowing the use of the same type of equipment for filling the borehole whether or not a particular borehole is partially filled with water.

As explosives 26 flow down through tube 10, it is expected that the water pressure, beginning at the water level 14, will cause the explosives 26 to be backed up from water level 14. However, as more explosives are added, the water pressure will be overcome by the weight of the explosives, and the explosives 26 will continue to flow to the base 22 of tube 10.

When the explosives reach the base 22 of tube 10 they will begin to flow out of tube 10 through apertures 18. Since apertures 18 will be located at or near the bottom of borehole 12, and since the explosives 26 used are typically more dense than water, the explosives will begin to fill borehole 12. This can be done without a large amount of mixing between the water in the borehole and the explosive mixture. Indeed, once a steady flow of explosives is established and the hole begins to fill, the only significant interaction between the water and the explosives will be at the explosive-water interface. Such an interaction is not extensive enough to cause a significant amount of AN dissolution or water entrapment.

FIG. 3 illustrates the present invention after the explosive has been completely placed at the bottom of the borehole. The explosive 26 fills the hole up to the level designated as the explosive-water interface. The tube 10 can be left in the hole because of the fact that it is inexpensive and easy to reproduce or it can be removed for subsequent reuse. At this point the explosive is in a position to be detonated by any known and desired means such as through the use of a conventional primer.

One explosive which works well in connection with the present invention, and which was discussed briefly above, is a HEF/AN mixture. HEF is essentially an emulsion of oil and an aqueous solution of ammonium nitrate and is manufactured by Mining Services International of Salt Lake City, Utah. HEF and the AN prills are combined in a ratio of approximately 1:1 to form an effective explosive for below ground use. The HEF acts to coat the AN prills, thereby making the AN prills water resistant. The mixture can be readily flowed down tube 10 and put in place at the bottom of the borehole 12 without significantly disturbing the HEF-/AN ratio and without trapping a large amount of water within the explosive.

From the foregoing, it will be appreciated that the present invention avoids prill dissolution, disturbance of the HEF/AN ratio, compression of the explosive to the point that the void volume is detrimentally reduced, and the trapping of large amounts of water within the explosives. The result of avoiding these problems is that the oxygen balance of the explosive is not disturbed and the weight strength and the bulk strength of the explosive is maintained. Moreover, this can be achieved without employing the expensive, time consuming and complex equipment and methods found in the prior art. Thus, the loading processes and apparatus of the present invention allow for use of more cost effective bulk blasting agents as opposed to the expensive slurry and emulsion explosives of the prior art.

In addition, the present invention also avoids the significant safety hazards encountered in the prior art, such as the rupture of high pressure hoses carrying explosives and the detonation of explosives while attempting to remove metal tubes from the borehole. At the same time, the present invention allows an efficient explosive mixture having a high weight strength and bulk strength to be delivered to the bottom of the borehole.

It will be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A method for delivering explosive to a specified level within a borehole comprising the steps of:

obtaining a length of collapsible tubing having an input end and an open delivery end, said collapsible tubing having a diameter which is less than the diameter of the borehole;

weighting the delivery end of said tubing sufficiently to assure that the delivery end will urge the tubing toward the bottom of the borehole;

lowering the delivery end of the tubing into the borehole to the desired depth while retaining the input end of the tubing near the surface;

collapsing by water pressure at least a portion of said tubing exposed to water; and flowing explosive into the input end of the tubing and into the borehole through the open delivery end.

2. A method for delivering explosive to the bottom of a borehole containing water comprising the steps of:

obtaining a length of tubing having an input end and a delivery end, said tubing having a diameter less than the diameter of the borehole;

weighting the delivery end of said tubing and lowering the delivery end of the tubing through the water to the bottom of the borehole;

collapsing by water pressure at least a substantial portion of the length of the tubing exposed to the water;

placing explosive into the input end of the tubing and communicating the explosive by gravity to the delivery end of the tubing; and displacing water in the borehole with the explosive.

3. A method as set forth in claim 2 wherein said weighting step comprises inserting weighted material in the delivery end of the tubing.

4. A method as set forth in claim 2 wherein said displacing step is preceded by flowing the explosive through pre-cut apertures in the delivery end of the tubing.

5. A method as set forth in claim 2 further comprising lubricating the interior surface of the tubing with a limited amount of water by passing water through interstices in the tubing as explosive material is communicated therethrough.

6. A method as set forth in claim 2 further comprising the step of initiating the explosive without removal of the tubing from the borehole.

7. A method for delivering an explosive to the bottom of a borehole containing water comprising the steps of:

obtaining a length of collapsible woven polypropylene tubing having a diameter smaller than the diameter of the borehole and a length approximately equal to the depth of the borehole;

attaching to the base of said tubing a weight sufficient to assure that the tubing will sink when placed in water;

lowering the tubing into the borehole until the base of the tubing reaches the bottom of the borehole while retaining the mouth of the tubing near the surface;

collapsing by water pressure the tubing along a portion of its length immersed in the water;

flowing explosives by gravity feed into the mouth of the tubing; and delivering the explosive to the borehole below water level through at least one aperture near the base of the tubing.

8. An apparatus for delivering a material, such as an explosive, to a specified level within a borehole containing water comprising:

a tube collapsible by water pressure in at least a portion of the tube exposed to water, said tube having a diameter which is less than the diameter of the borehole in which it is to be used;

means for weighting one end of the tube such that the tube will be gravity displaceable to the bottom of the borehole; and at least one aperture in the one end of the tube near its base.

9. Apparatus for delivering an explosive to the bottom of a borehole containing water comprising:

a water-collapsible woven polypropylene tube with a diameter smaller than the borehole in which it is to be used and a length approximately equal to the depth of the borehole in which it is to be used, said tube being collapsible by water pressure in at least a portion of said tube exposed to water;

a weight attached to one end of the base sufficient to assure that the tube will be gravity displaced through water; and a plurality of apertures in the tube.

10. An apparatus as defined in claim 8 wherein the length of the tube is approximately equal to the depth of the borehole in which it is to be used.

11. An apparatus as defined in claim 8 wherein the tubing is water impermeable.

12. An apparatus as defined in claim 8 wherein the tubing is water permeable.

13. An apparatus as defined in claim 8 wherein the tubing is made of woven polypropylene.

14. A method for delivering explosive to a specified level within a borehole containing water comprising the steps of:

obtaining a length of tubing having an input end and a delivery end, said tubing having a diameter less than the diameter of the borehole;

weighting the delivery end of said tubing and lowering the delivery end of the tubing to below the surface of the water contained within the borehole to a desired depth while retaining the input end of the tubing near the top of the borehole;

collapsing by water pressure at least a portion of the length of the tubing exposed to the water;

placing explosive into the input end of the tubing and communicating the explosive by gravity to the delivery end of the tubing; and displacing water in the borehole with the explosive.

15. A method as set forth in claim 14 wherein said weighting step comprises inserting weighted material in the delivery end of the tubing.

16. A method as set forth in claim 14 wherein said displacing step is preceded by flowing the explosive through pre-cut apertures in the delivery end of the tubing.

17. A method as set forth in claim 14 further comprising lubricating the interior surface of the tubing with a limited amount of water by passing water through interstices in the tubing as explosive material is communicated therethrough.

18. A method as set forth in claim 14 further comprising the step of initiating the explosive without removal of the tubing.

* * * * *

UNITED STATES PATENT AND TRADEMARK OFFICE

CERTIFICATE OF CORRECTION

PATENT NO. : 4,572,075

DATED : February 25, 1986

INVENTOR(S) : John T. Day et al.

It is certified that error appears in the above-identified patent and that said Letters Patent is hereby corrected as shown below:

Column 2, line 29, "compounds" should be --compounds)--
Column 2, line 30, "increast" should be --increase--
Column 3, line 30, "at bottom" should be --at the bottom--
Column 3, line 38, "quantites" should be --quantities--
Column 7, line 10, "permeable," should be --permeable;--
Column 9, line 64, "flowing explosive" should be preceded by a new subparagraph.

Signed and Sealed this

*Seventeenth* Day of *June 1986*

[SEAL]

*Attest:*

DONALD J. QUIGG

*Attesting Officer*

*Commissioner of Patents and Trademarks*